United States Patent [19]

De Laney

[11] 4,254,951

[45] Mar. 10, 1981

[54] FENCING POINT DEVICE

[76] Inventor: Jan R. De Laney, 530 Bryan St., Tallahassee, Fla. 32304

[21] Appl. No.: 936,496

[22] Filed: Aug. 24, 1978

[51] Int. Cl.[3] ..... A63B 69/02

[52] U.S. Cl. ..... 273/1 F; 273/1 E; 200/61.42

[58] Field of Search ..... 273/1; 272/98; 200/61.42, 44, 58 R, 76, 78

[56] References Cited

U.S. PATENT DOCUMENTS

| | | | |
|---|---|---|---|
| 2,334,271 | 11/1943 | Malm | 200/61.42 |
| 2,783,468 | 2/1957 | Pistoles | 200/61.42 |
| 2,916,287 | 12/1959 | Davey | 273/1 F |

FOREIGN PATENT DOCUMENTS

| | | | |
|---|---|---|---|
| 1132671 | 11/1956 | France | 273/1 F |

*Primary Examiner*—Richard T. Stouffer
*Assistant Examiner*—R. Carl Moy
*Attorney, Agent, or Firm*—Donald D. Denton

[57] ABSTRACT

An electrical fencing point device having a weighted spring-biased tip depressible in a body section of the point to complete an electrical circuit to a scoring apparatus for registering a hit, the body section being quickly separable to give access to the weight spring. The depressible tip has an adjustable contact means that is adjustable from outside the tip for varying the sensitivity of making contact with an electrical contactor for completing a circuit to the scoring apparatus for registering a hit.

6 Claims, 3 Drawing Figures

FENCING POINT DEVICE

This invention relates in general to the art of fencing and more particularly to a fencing point device for attachment to the tip end of a fencing blade or similar weapon which, when electrically connected to an electrical scoring apparatus, automatically registers the first touch or hit by one of the contestants during a fencing match.

Many types of fencing points are present in the art, but since these points are very small, adjustment of the weight spring to improve their sensitivity of recording a hit as desired is difficult, and making the necessary adjustment often requires the removal of two small screws that can be lost easily and/or the use of specialized tools. Such adjustments also are time consuming due to the difficulty of access to the weight spring.

The following patents show types of fencing points that form part of the prior art that is known to the applicant:

U.S. Pat. No. 2,916,287
British Pat. No. 1,120,613
French Pat. No. 1,082,459
French Pat. No. 1,404,045
French Pat. No. 1,155,442
Swedish Pat. No. 220,069

SUMMARY OF THE INVENTION

This invention provides a new and different electrical fencing point for attachment to the tip portion of a fencing blade for use in fencing matches, employed where an electrical scoring apparatus is used, the improvement being in the ease of access to the weight spring to adjust the touch sensitivity of the point.

The electrical fencing point of this invention is formed from a conductive hollow body section having upper and lower body members which are detachably screwed or otherwise fastened together. The upper body member has a depressible tip means, having limiting movement, insulated from the upper body member, and the lower body member has a cavity adapted to retain a weight or tension spring positioned at one end on an electrical contactor insulated from said lower body member and electrically connected to a recording apparatus, the weight spring holding the tip means in a non-depressed position. The lower body member has means for attaching to the tip portion of the fencing blade.

In one embodiment of the invention, an adjustable screw means is positioned in the tip means having a dependent end with a boss that has connected to it a travel spring. The unconnected end of the travel spring has a free end that, upon depressing the tip means, brings the end into contact with an insulated second contactor means that is electrically connected to the recording apparatus to record a hit or touch during the contest.

BRIEF DESCRIPTION OF THE DRAWINGS

These and other objects will become apparent from the following description of preferred embodiments and the drawings, in which.

DESCRIPTION OF PREFERRED EMBODIMENTS

Figure 1:
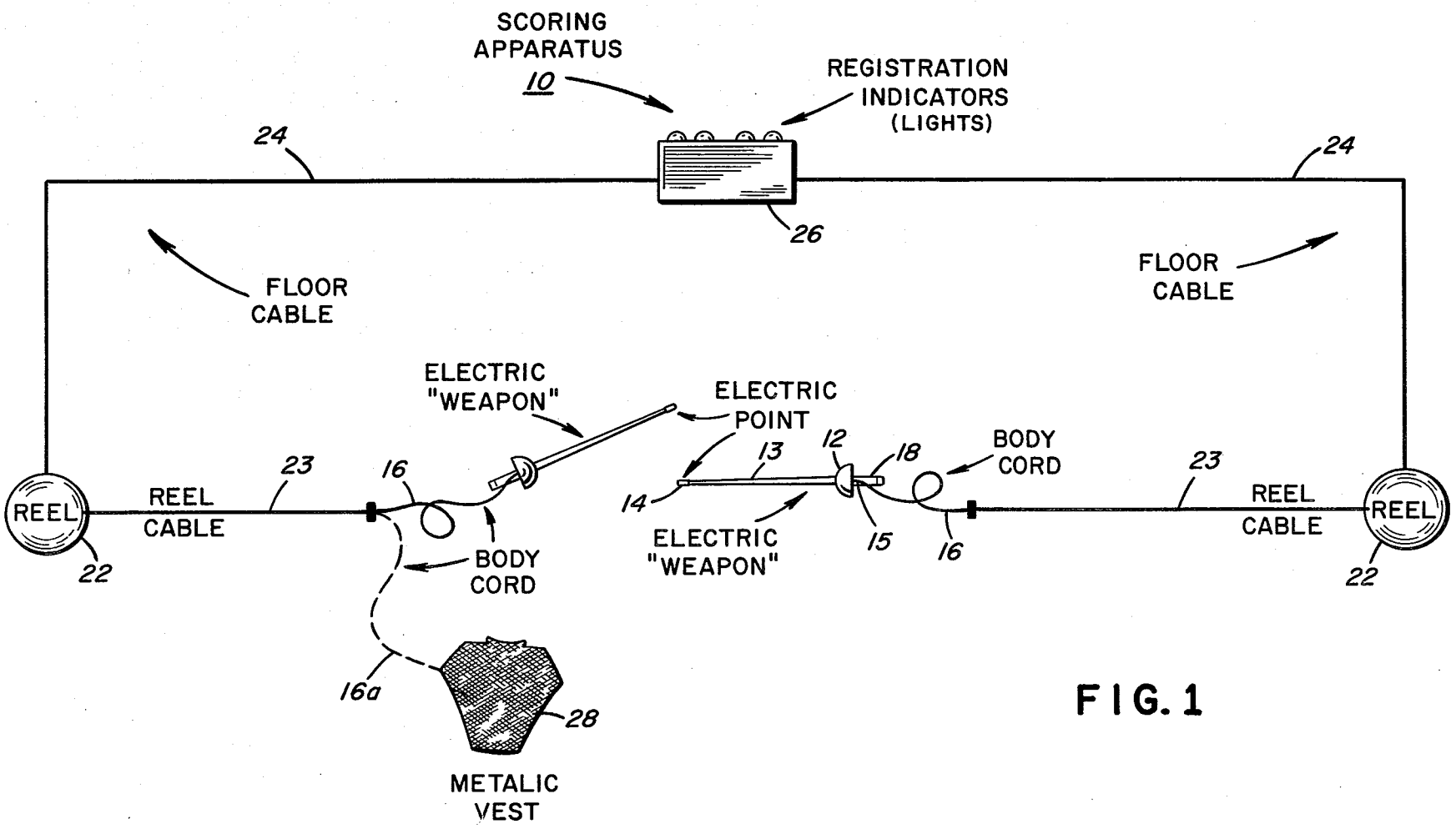
FIG. 1 illustrates diagrammatically a known scoring apparatus with fencing foils electrically connected to a hit registering device with a metal vest shown connected by a dashed line when the electrical fencing point is a foil point.

Numeral 10 in FIG. 1 illustrates a scoring apparatus used in this invention. Foils 12 have a blade 13 and an electrical fencing point 14 attached to one end of foil 12 and a guard and socket 15. At the other end a body cord 16 is connected to socket 15 at handle portion 18 which is operatively and electrically connected with a top portion 20. The body cord 16 is in turn attached to a reel 22 by a reel cable 23 which is capable of automatically winding and unwinding as the contestant moves in a fencing match.

A floor cable 24 electrically attaches the reel cable 23 to a recording apparatus 26 or means for registering a hit by one contender on his opponent. The registration of a valid hit in foil competition (using the fencing point shown in FIG. 3) requires the use of a metal vest 28 which is attached to reel cable 23 by body cord **16*a* (in dashed line). It will be appreciated that where the contest is with epee, the scoring apparatus is in an epee mode (using the fencing point shown in FIG. 2**) and no metallic vest is required for valid hit registration.

Figure 2:
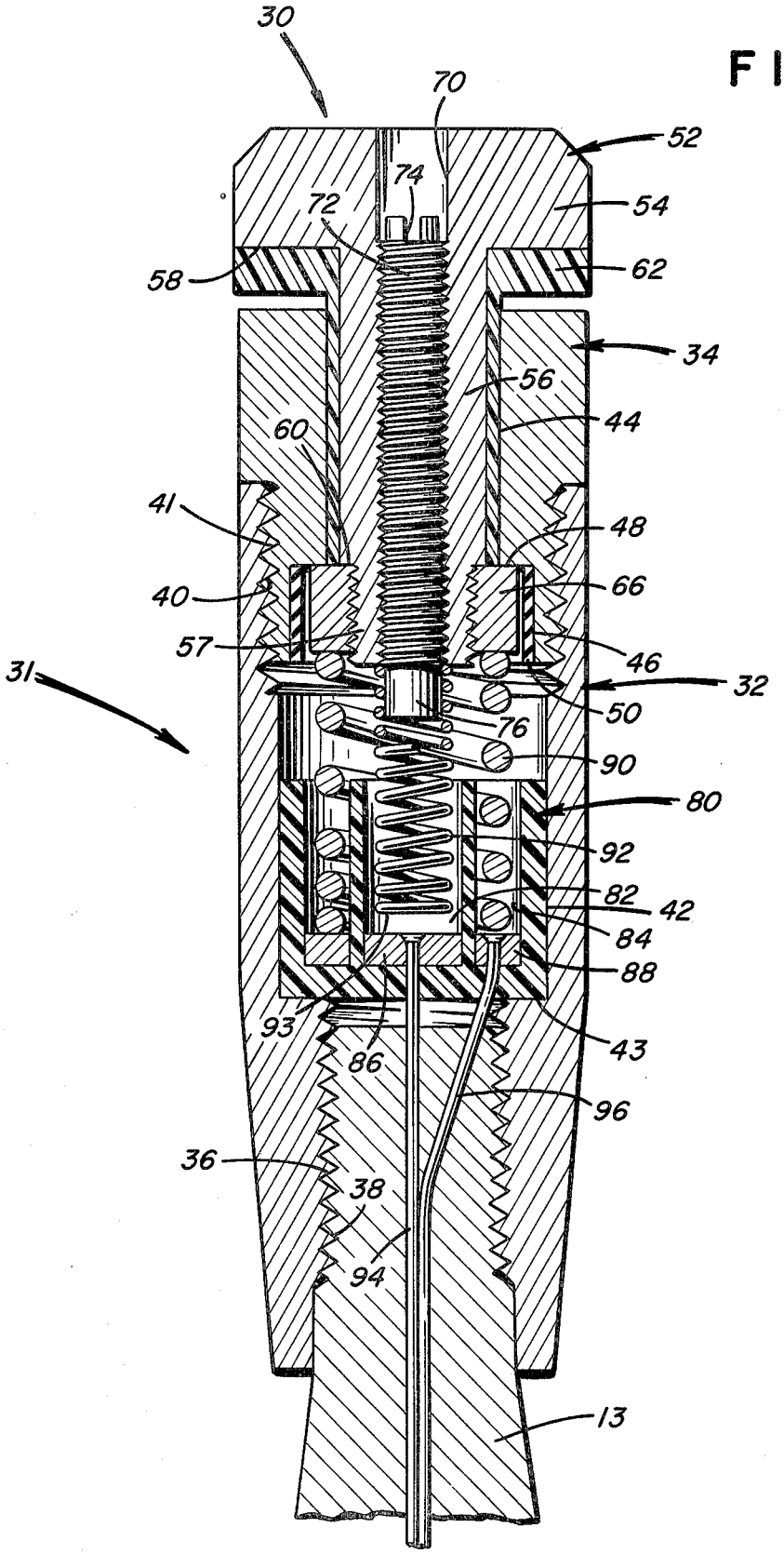
FIG. 2 shows a cross-sectional view of an epee point having a depressible spring-biased point and an adjusting screw means for limiting travel of the point before an electrical circuit is closed for registering a hit.

FIG. 2 shows an epee point 30 that, when used, is attached to blade 13. The point 30 has a hollow body section 31 having a lower body member 32 and an upper body member 34. One end of the body member 32 has an internal thread 36 adapted to be attached to a threaded end 38 of blade 13 of the fencing foil 12. The other end of body member 32 has internal threads 40 and further defines a cavity 42 having a shoulder 43.

An upper body member 34 has an externally threaded end 41 adapted to threadedly engage the internal threads 40 of the lower body member 32. The upper body member has two concentric bores 44 and 46 of different diameters which form a continuous hole in the body member and, when the two bores meet, define a shoulder 48. Positioned against the surface of bore 46 is an insulator ring 50.

Slidably positioned in upper body member 34 is a tip means 52 having a head 54 of a diameter equal to the diameter of the upper and lower body members 34 and 32, respectively, and a small sliding section 56 which forms a circular shoulder 58 with section 54 and at a further extension of the small portion 56 there is a second shoulder 60 formed by a reduction portion 57 in diameter of the small portion 56.

The outer surfaces of shoulder 58 and the small diameter section 56 have an insulation shield 62. Positioned on the reduced section of small portion 56 is a retaining collar 66 which contacts the shoulder 60 restricting upward sliding movement of tip means 52. The insulated covered circular shoulder 58 restricts downward movement beyond a set amount. A borehole 70 is centrally positioned in tip 52 and contains a threaded shaft screw 72. Shaft screw 72 has a screw slot 74 at one end and a cylindrical boss 76.

Retention of the tip means 52 may be accomplished by threading portion 57 and collar 66 so as to firmly attach the retaining collar 66 against the reduction portion 57 in the small portion 56.

The lower body member 32 has positioned in it a dual cup-shaped insulated means 80 which defines a central circular cup 82 and an annular shaped cup 84, and positioned in the bottom of each cup is an electrical contactor or conductor means or member 86 and 88, respectively. Positioned in cup 84 is a weight or tension biasing means or spring 90 which, when the upper and lower body members are assembled, urges the tip means 52 to its uppermost position with annular collar or means 66 abutting against second shoulder 60.

Dependent from boss 76 is a travel contacting spring or means 92 having a free end 93 which, when the tip is in its uppermost position, is out of contact with contact member 86 and is brought into contact only when the tip means 52 is depressed such as by a hit.

The adjustment of the amount of travel for contacting spring 92 can be made simply using a jeweler's screwdriver by inserting the blade of the screwdriver in slot 74 and turning the screw shaft 72 either in or out depending on the sensitivity of contacting desired.

Electrical lead paths or passageways 94 and 96 are provided for wire connection to conductor members 86 and 88, respectively, the leads passing through passageways 94 and 96 in the blade 13 to handle portion of the foil where they are electrically connected through a socket arrangement 15 to body cord 16 to form an electric circuit with the electrically powered scoring apparatus 26.

The electrical function of the "epee" point 30 provides an electrical pathway when the tip is depressed by moving the contactor spring 92 into contact with contactor means 86 thus registering a touch or hit. The tip means 52 is insulated from the body section, and only when the tip is depressed does the free end 93 of the contactor spring 92 provide for continuity of the circuit. Thus, the applicant's fencing point allows for the scoring apparatus to distinguish between on-target and ground hits. By depressing the tip means against a non-grounded surface, a circuit is formed and the scoring apparatus 26 makes a registration. If the surface is grounded, the apparatus will sense this through the tip and suppress any registration.

It will be appreciated that applicant's "epee" point provides the following important functions: quick and easy access to the weight spring by having a two-piece body section; a new and different electrical contact mechanism for registering a hit; and the ability for quick and easy adjustment of sensitivity of making electrical contact without having to take the fencing point apart to adjust the mechanism of the fencing point.

Figure 3:
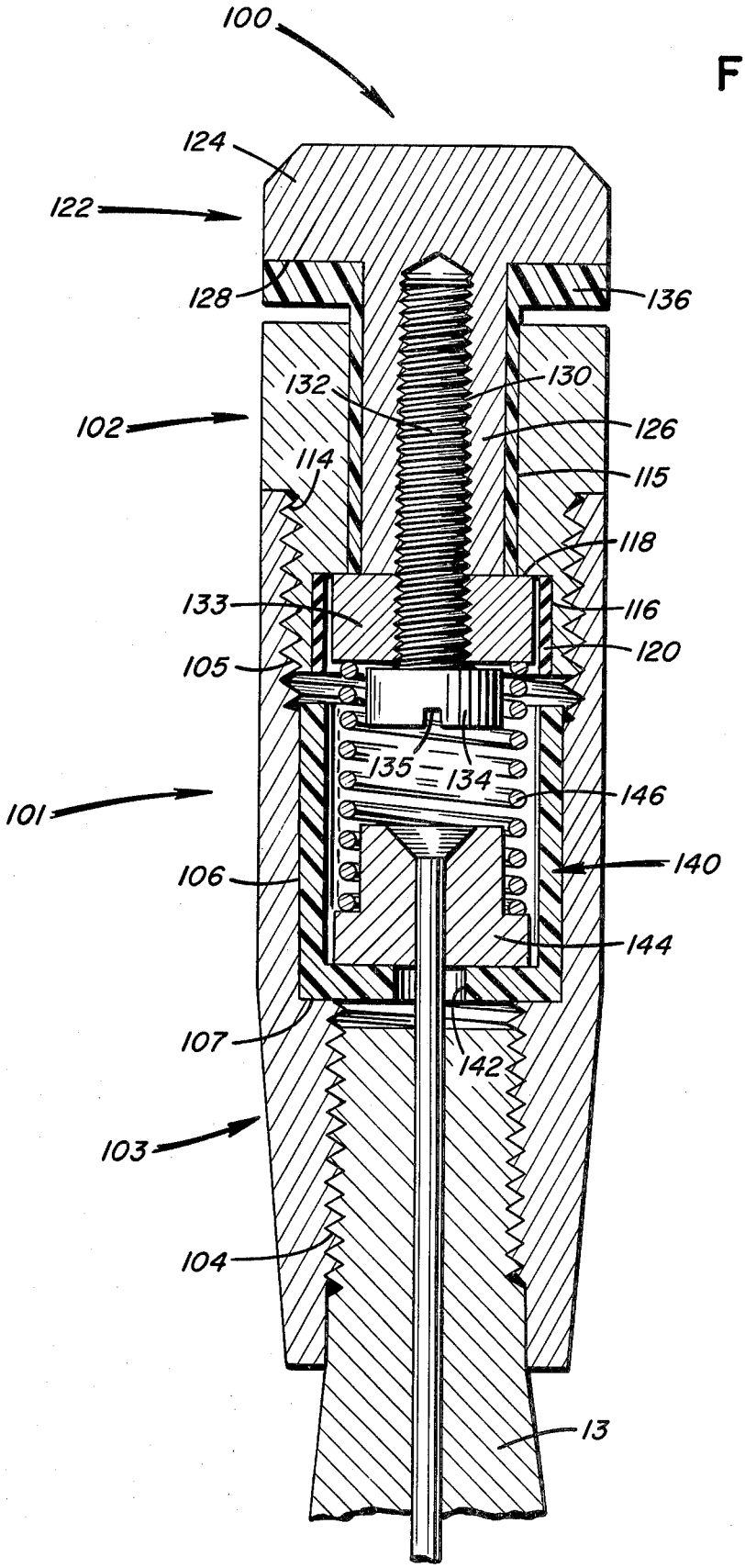
FIG. 3 is an alternate showing of a "foil" point in cross-section showing a spring biased point.

In another preferred embodiment illustrated by FIG. 3, a foil point 100 is used with an apparatus of the general type shown in FIG. 1. This point has a hollow body section 101 having upper and lower body members 102 and 103, respectively. The lower body member 103 has at one end an internal thread or attaching means 104 which permits mounting of the foil point on blade 13 by engagement with the threaded end 38 of the blade. The other end of the lower body member has internal thread 105 and defines cavity 106 with a bottom annular shaped shoulder 107.

As in FIG. 2, an upper body member 102 has an externally threaded end 114 adapted to threadedly engage the internal thread 105 of the lower body member 103. The upper body member has two concentric bores 115 and 116 of different diameters, and where they meet forms a shoulder 118. Positioned against the surface of bore 116 is an annular insulator ring 120. Positioned so as to slide in the bore 115 is a tip portion 122 having a head section 124 substantially equal in diameter to the diameter of the upper and lower body members 102 and 103. Attached to the head section 124 is a smaller diameter section 126 which forms a first shoulder 128. From the bottom surface of tip portion 122, a threaded hole 130 is positioned which is concentric and in line with the centerline of bores 115 and 116. A threaded screw 132 is operatively positioned in threaded hole 130 having a threaded retaining collar 133 of larger diameter than the diameter of small diameter section 126. The end portion of thread screw 132 has a head portion 134 with a slot 135. The outer surfaces of shoulder 128 and the smaller diameter section 126 have an insulation shield 136 to prevent electrical continuity between foil point 100 and body portion 102, except through collar 133 when in contact with shoulder 118.

Positioned in cavity 106 and resting against shoulder 107 in the lower body member 103 is an insulated cup member 140 having an opening 142. Within the cup member 140 is a conductive block member 144 which is adapted to be electrically connected to a conductor (not shown) that electrically connects the conductive block member 144 to the recording apparatus 26.

Positioned within the insulated cup member and resting at one end on the conductive block member is a weight spring or biasing means 146, with the other end fitting over the head portion 134, thereby providing a depressible tip means having electrical continuity between the tip means and the conductive block.

The electrical path of the foil point is from the wire which runs the length of the blade to the inside of the insulated cup 144. The weight spring 146 provides circuit continuity to the base of the tip which is forced against the threaded retaining collar 133. This collar may be kept in place by one retaining screw 132. The retaining collar held by the retaining screws completes the circuit to the blade which is in effect the other conductor.

When the tip is depressed, contact with the retaining collar 133 is broken. A surface that has no contact with the scoring apparatus against which the tip means is depressed results in an off-target registration. A metallic surface such as metallic vest 28 that comprises the valid target area against which the tip means is depressed results in an on-target registration. This is possible as the tip means is part of the circuit through the weight spring contacting the wire or solid metal at the bottom of the insulation cup and consequently down the length of the barrel to the socket in the guard and to the recording apparatus. A metallic surface connected to the recording apparatus as a ground against which is depressed the tip means will result in a non-registration.

Access to the weight spring 146 is accomplished simply by unscrewing the two-piece body section 101 which is shown as threaded at its middle.

It will be appreciated that the fencing point device of this invention can be made from any material with parts that are to be part of the continuity path for electrical recordation made of conductive material.

It will also be appreciated that various changes and/or modifications may be made within the skill of the art without departing from the spirit and scope of the invention illustrated, described, and claimed herein.

What is claimed is:

1. A fencing point device adapted to be attached to a free end of a fencing blade or similar weapon that is electrically connectable to a means for recording a hit on a recording apparatus during a fencing match, which point comprises a hollow body section having a lower body member having means for attachment to said free end of said blade and an upper body member, said upper and lower body members having attachment means therein for removably connecting them together, a protruding depressible conductive tip means slidably mounted in said upper hollow body member having a conductive tip retaining means positioned on the end of the tip means that extends into said hollow body section, said retaining means and said tip means having electrical insulation means to insulate them from said hollow body section when depressed, a first conductive spring biasing means positioned in said lower body member in contact with a first electrical conductor means and said retaining means to maintain said tip in a protruded position, an adjustable screw shaft means centrally positioned in said tip means with one end thereof extending in said hollow body and the other end having an adjustment means thereon just below the surface of the face of the tip means, a second conductive spring biasing means attached to the end of said screw means that depends in said hollow body adjustably positioned above a second electrical conductor means, said first and second conductor means having insulation means therebetween, whereby said screw shaft means can be manually adjusted from the outside of said point device for length of travel of said tip means when it is depressed before contact is made between the depending end of said second biasing means and said second conductor means to record a hit.

2. The fencing point device of claim 1 in which said first and second electrical conductor means are each positioned in an insulated cup means having an annular compartment and an inner circular compartment concentric with each other and each compartment insulated from the other, said first electrical conductor means positioned in said annular compartment and said second electrical conductor means positioned in said circular compartment, and electric wire means connectable to each of the said first and second electrical conductor means for providing current pathways to said recording apparatus, and said tip means having its adjustable screw shaft means positioned centrally and having a boss that extends from the lower end of said tip means, and said second conductive spring biasing means being an electrically conductive traveler contact spring having a free end with the other end attached to said boss, said free end of said second conductive spring biasing means contacting said second electrical conductor means when said tip means is depressed.

3. The fencing point device of claim 2 in which said adjustable screw shaft means is adjustable from the top of the tip means to vary the distance of travel of the free end of said second electrically conductive spring biasing means from said second electrical conductor means when said tip means is depressed.

4. The fencing point device of claim 1 in which said tip retaining means is a conductive collar connected to the lower portion of said tip means for making or breaking contact with said upper body member.

5. The scoring system for recording hits during a fencing match having a recording apparatus electrically connecting a pair of fencing weapons to record a target hit when said point of one contestant makes a hit, said weapons each having the fencing point device of claim 1.

6. The fencing point device of claim 1 in which the lower body member has a threaded end portion for attachment to a threaded end of the fencing blade and the said upper body member has external threads and the said lower body member has internal threads that when engaged connect the two members together, and a retaining edge positioned in said upper member that is contacted by said retaining means when the tip means is not depressed.

* * * * *